US009979144B2

(12) United States Patent
Amir et al.

(10) Patent No.: US 9,979,144 B2
(45) Date of Patent: May 22, 2018

(54) CONNECTOR ASSEMBLY FOR SMART GARMENTS

(71) Applicant: HEALTHWATCH LTD., Herzliya (IL)

(72) Inventors: Uri Amir, Or Yehuda (IL); Boaz Shoshani, Raanana (IL)

(73) Assignee: HEALTHWATCH LTD., Herzeliya (IL)

( * ) Notice: Subject to any disclaimer, the term of this patent is extended or adjusted under 35 U.S.C. 154(b) by 0 days. days.

(21) Appl. No.: 15/302,941

(22) PCT Filed: Apr. 16, 2015

(86) PCT No.: PCT/IL2015/050411
§ 371 (c)(1),
(2) Date: Oct. 7, 2016

(87) PCT Pub. No.: WO2015/159297
PCT Pub. Date: Oct. 22, 2015

(65) Prior Publication Data

US 2017/0040758 A1 Feb. 9, 2017

Related U.S. Application Data

(60) Provisional application No. 61/981,213, filed on Apr. 18, 2014, provisional application No. 62/014,753, filed on Jun. 20, 2014.

(51) Int. Cl.

| | |
|---|---|
| ***H01R 33/00*** | (2006.01) |
| ***H01R 24/60*** | (2011.01) |
| ***H01R 12/53*** | (2011.01) |
| ***H01R 13/52*** | (2006.01) |
| ***H01R 13/66*** | (2006.01) |
| ***A41D 1/00*** | (2018.01) |

(Continued)

(52) U.S. Cl.
CPC ..... *H01R 24/60* (2013.01); *A41D 1/005* (2013.01); *H01R 12/53* (2013.01); *H01R 13/5213* (2013.01); *H01R 13/6666* (2013.01); *H01R 11/24* (2013.01); *H01R 2107/00* (2013.01); *H01R 2201/12* (2013.01); *H01R 2201/20* (2013.01)

(58) Field of Classification Search
CPC .... H01R 24/60; H01R 12/53; H01R 13/5213; H01R 13/6666; H01R 11/24; H01R 2107/00; H01R 2201/12; H01R 2201/20; A41D 1/005
USPC ..... 439/37, 502, 623, 624
See application file for complete search history.

(56) References Cited

U.S. PATENT DOCUMENTS

| | | | |
|---|---|---|---|
| 7,277,743 | B2 | 10/2007 | Brodnick |
| 7,337,810 | B2 | 3/2008 | Orr et al. |

FOREIGN PATENT DOCUMENTS

| | | | |
|---|---|---|---|
| DE | 102006019269 | A1 | 10/2007 |
| WO | 2013134856 | A1 | 9/2013 |

*Primary Examiner* — Khiem Nguyen
(74) *Attorney, Agent, or Firm* — Troutman Sanders LLP

(57) ABSTRACT

A connector-and-cable assembly, including an electronic connector, such as a HDMI connector, having an outlet section and a multiplicity of elastic conductive stripes. Each of the elastic conductive stripes is conductively connected, at a first end, to a respective preconfigured outlet pin of the electronic connector. The second end of each of the elastic conductive stripes is preconfigured to operatively attach to a respective sensor, such as a textile electrode of a smart garment. Typically, at least one of the elastic conductive stripes is a textile based conductive stripe.

16 Claims, 6 Drawing Sheets

(51) Int. Cl.

| | |
|---|---|
| *H01R 11/24* | (2006.01) |
| *H01R 107/00* | (2006.01) |

Detailed A

CONNECTOR ASSEMBLY FOR SMART GARMENTS

CROSS REFERENCE TO RELATED APPLICATIONS

This application is a United States national stage entry of an International Application serial no. PCT/IL2015/050411 which claims the benefit under 35 USC 119(e) from U.S. provisional application 61/981,213 filed on Apr. 18, 2014 and U.S. provisional application 62/014,753 filed on Jun. 20, 2014, the disclosures of which are included herein by reference.

This application also relates to the PCT/IL2013/050964 ('964) filed on Nov. 23, 2013, the disclosure of which is included herein by reference in its entirety.

FIELD OF THE INVENTION

The present invention relates to textile-based, wearable health monitoring systems and more particularly, the present invention relates to devices and methods for physically connecting electronic devices to a garment with integrated textile electrodes.

BACKGROUND OF THE INVENTION AND PRIOR ART

Smart garments are designed to monitor living beings wearing the smart garment. A smart garment may include a variety of textile sensors for detecting different physiological parameters of the living being. Smart garments also include a processor for analyzing the sensed data. Typically, the textile sensors have conductive textile traces that facilitate transmitting the sensed data from the textile sensors to the processor.

Typically, the smart garment is coupled to operate with an electronic processing device, for analyzing different physiological parameters of the wearer of the smart garment. Also there is often a need for quick engagement/disengagement of the processor, for example, when washing the garment.

BRIEF SUMMARY OF THE INVENTION

It is an intention of the present invention to provide devices and methods for physically connecting an electric connector, for use by preconfigured electronic devices, to respective integrated textile electrodes of a smart garment. The textile electrodes may be used for obtaining high quality ECG signals and other biological signals.

It is an intention of the present invention to provide a method for securely connecting conductive textile yarns to electric connector.

It is an intention of the present invention to provide a method for securely connecting conductive textile yarns to electric connector, such that the connector is sealable to facilitate machine washing and machine drying.

It is an intention of the present invention to provide elastic conductive textile stripe that can be starched with the elastic garment.

It is an intention of the present invention to provide elastic conductive textile stripe that the conductivity of the stripe can be predesigned. The conductive textile stripe may be braided using a preconfigured number of conductive yarns to provide desired conductivity for a preconfigured stripe length.

According to the teachings of the present invention, there is provided a connector-and-cable assembly, including an electronic connector having an outlet section and a multiplicity of elastic conductive stripes. Each of the elastic conductive stripes is conductively connected, at a first end, to a respective preconfigured outlet pin of the electronic connector. The second end of each of the elastic conductive stripes is preconfigured to operatively attach to a respective sensor.

Optionally, the electronic connector is a HDMI connector.

Optionally, at least one of the elastic conductive stripes is a textile based conductive stripe.

Optionally, the sensor is a textile electrode of a smart garment.

Preferably, the connector-and-cable assembly is made of materials withstanding washing by washing machines and drying by drying machines.

Optionally, the electronic connector includes a PCB board having a multiplicity of connector pins, wherein each of the elastic conductive stripes is securely and conductively attached to a respective pin of the multiplicity of connector pins.

Optionally, the securely attachment of the each of the elastic conductive stripes to a respective pin of the multiplicity of connector pins is done either by pressing the respective pin onto the respective conductive stripe, or by using conductive glue or by a combination thereof.

Optionally, the PCB board includes at least one protective means that breaks open a respective electric line, upon a high electric surge.

Optionally, the electronic connector includes a connector-housing, wherein the connector-housing and a portion of the elastic conductive stripes, proximal to the electronic connector, are wrapped by a mold.

Optionally, the connector-and-cable assembly further includes a fitted cap plugged into the open end of the electronic connector, to thereby further seal the connector-and-cable assembly.

Optionally, the connector-and-cable assembly further includes an attachment element for securing the connector-and-cable assembly onto a smart garment.

Optionally, the outlet section of the electronic connector is generally perpendicular to the incoming direction of the conductive stripes, entering the electronic connector.

It is an aspect of the present invention to provide a HDMI interface (I/F) device facilitating any external monitoring unit to operatively connect to the smart garment via the connector-and-cable assembly. The HDMI interface (I/F) device includes a paired-connector inlet, an I/F housing having a first face and a second face, and a PCB I/F assembly. Each of the paired-connector inlet is adapted to operatively connect to the outlet section of the electronic connector.

A predetermined number of external connecting means are securely attached to the PCB I/F assembly, at locations preconfigured, at one or both sides of the PCB I/F assembly. Respective openings, at locations corresponding to locations of the external connecting means on the PCB I/F, are formed in the first and/or second faces of the I/F housing, to facilitate access to the external connecting means.

Optionally, the paired-connector inlet is adapted to fit the outlet section of the electronic connector.

Optionally, the external connecting means is selected from the group including snap buttons and crocodile connectors.

Optionally, the PCB I/F assembly includes at least one protective means that breaks open a respective electric line upon a high electric surge.

Optionally, the external monitoring unit is an ECG processing and monitoring unit.

BRIEF DESCRIPTION OF THE DRAWINGS

The present invention will become fully understood from the detailed description given herein below and the accompanying drawings, which are given by way of illustration and example only and thus not limitative of the present invention, and wherein.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided, so that this disclosure will be thorough and complete, and will fully convey the scope of the invention to those skilled in the art.

An embodiment is an example or implementation of the inventions. The various appearances of "one embodiment," "an embodiment" or "some embodiments" do not necessarily all refer to the same embodiment. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments", "another embodiment" or "other embodiments" means that a particular feature, structure, or characteristic described in connection with the embodiments is included in at least one embodiment, but not necessarily all embodiments, of the inventions. It is understood that the phraseology and terminology employed herein is not to be construed as limiting and are for descriptive purposes only.

Figure 1:
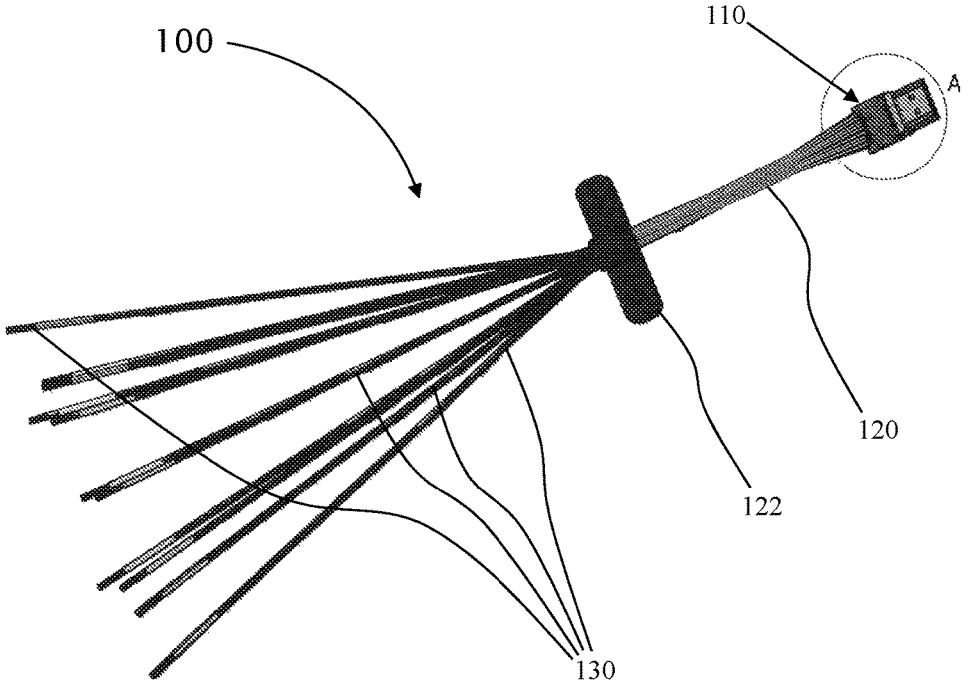
FIG. 1 is a perspective view of an example sealed HDMI connector, according to embodiments of the present invention, having textile conductive stripes coming out of the connector, wherein the sealing mold is removed for illustrative purposes only.
Figure 2:
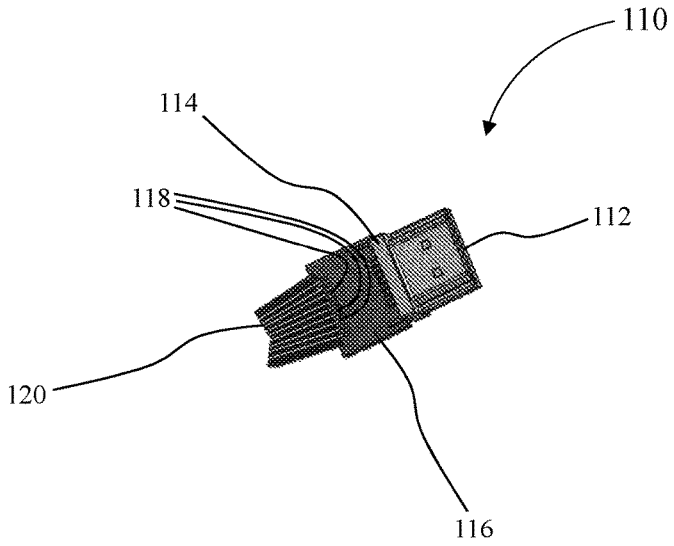
FIG. 2 is a detailed magnification (1:2) A of the connector section, as shown in FIG. 1.
Figures 3A, 3B:
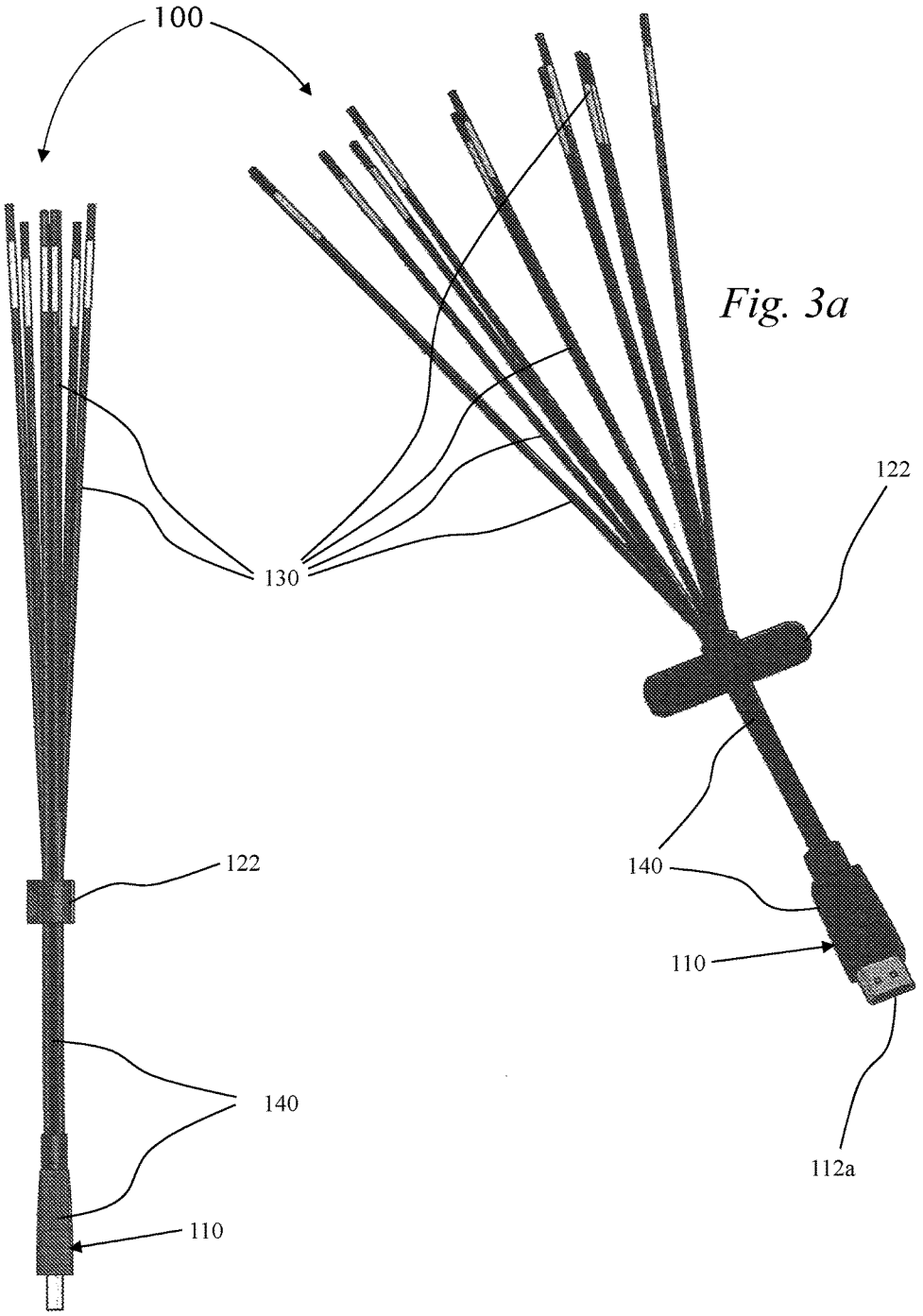
FIG. 3*a* illustrates the example sealed HDMI connector of FIG. 1, including the sealing mold.
FIG. 3*b* is a side view of the connector section, as shown in FIG. 3*a*.
Figure 3C:
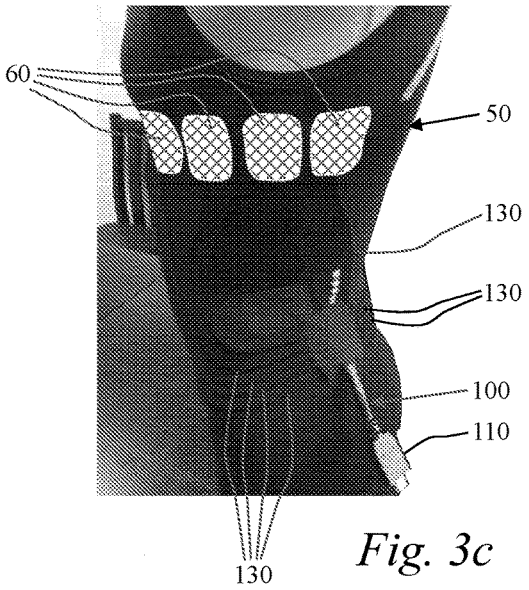
FIG. 3*c* depicts a side view of a smart garment utilizing a sealed HDMI connector and cables assembly, as shown in FIG. 3*a*.

Reference is made to the drawings. FIG. 1 illustrates an example sealed HDMI connector-and-cable assembly 100, according to embodiments of the present invention, having a connector 110 and elastic conductive stripes 130 coming out of connector 110, readily to be securely attached to preconfigured locations on the smart garment (not shown). The sealing mold has been removed from FIG. 1 for illustrative purposes only. FIG. 2 is a detailed magnification (1:2, with reference to FIG. 1) A of connector 110. FIG. 3*a* illustrates the example sealed HDMI connector-and-cable assembly 100, including sealing mold 140. FIG. 3*b* is a side view connector and cable assembly 100, as shown in FIG. 3*a* FIG. 3*c* depicts a side view of a smart garment 50 utilizing a sealed HDMI connector and cables assembly 100.

It should be noted that HDMI connector 110 is shown by way of example only, and any other types of electronic connectors may be used.

Connector 110 includes a small PCB board 116. The PCB board includes multiple pins 118 to which pins 118 conductive stripes 130 are securely attached, for example, with no limitations, by pressing each pin 118 onto a respective conductive stripe 130, by using conductive glue or a combination thereof.

The housing 114 of connector 110 is preferably wrapped by a mold 140 of sealing material such as rubber. Preferably, a preconfigured portion 120 of conductive stripes 130 is also wrapped by mold 140, to thereby seal the connector and portion 120 of conductive stripes 130, in particular to facilitate washing the garment by washing machines and drying using drying machines (up to about 80° C.). Typically, each conductive stripe 130 is designed to convey a single signal.

Preferably, to further seal connector 110, a fitted cap (not shown) is plugged into the open end 112*a* of connector 110, to thereby seal connector assembly 100 including connector 110 and up to attachment element 122.

In section 120 of conductive stripes 130, the individual conductive stripes 130 are also individually insulated.

Conductive stripes 130 are typically, with no limitations, made of elastic materials such as Nylon, and are coated with silver ions or another metal such as gold, copper or stainless steel. The stripes are typically braided such as to maintain elasticity that corresponds to the elasticity of the smart garment and does not limit the elasticity of the smart garment. Typically, each conductive stripe 130 is composed of a preconfigured number of individual conductive yarns, to thereby control the conductivity of that conductive stripe 130, typically, according to the length of that conductive stripe 130.

Typically, each braided conductive stripe 130 is composed of a preconfigured number of the individual conductive yarns that are individually wrapped with non-conductive yarns, such as Nylon or Polyester, to thereby insulate each conductive stripe 130.

Preferably, connector-and-cable assembly 100 includes an attachment element 122 for securing connector assembly 100 onto a smart garment 50, for example by sewing. Thereby, when pulling connector 110, the conductive stripes 130 do not pull the respective electrode 60 and distort the signal being sensed.

Preferably, connector-and-cable assembly 100, including conductive stripes 130, is designed to sustain at least 50 washing and drying cycles.

Typically, the free end of each braided conductive stripe 130 is securely attached to a preconfigured location of smart garment 50, for example to a respective electrode 60, for example by sewing or gluing with conductive glue. The attachment may be applied directly to the respective electrode 60. The attachment may also be applied to a preconfigured location on the smart garment, wherein that preconfigured location is electrically connected to a respective electrode, for example by another conductive stripe. Thereby, the signal obtained by the electrodes 60 may be transmitted via the conductive stripes 130 and connector 110 to an external electronic device preconfigured to receive such signals.

Figure 4:
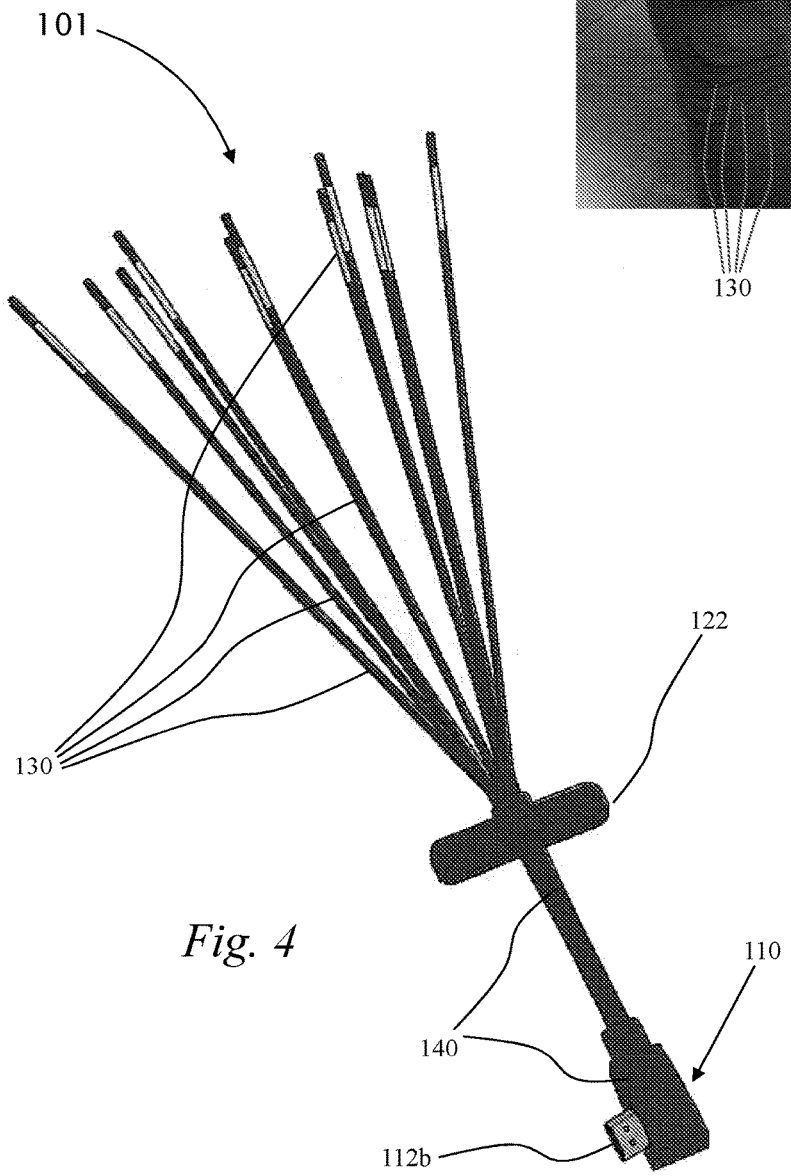
FIG. 4 illustrates another example variation of a sealed HDMI connector, including the sealing mold, wherein the connector outlet is generally perpendicular to the incoming attached lead cables.

Reference is now also made to FIG. 4, illustrating another example variation of a sealed HDMI cable and connector assembly 101, including the sealing mold 140, wherein the connector outlet 112*b* is generally perpendicular to the cable of conductive stripes 130. Thereby, when a processing unit is attached to connector outlet 112*b*, the processing unit does not apply pulling forces on connector 110 such that no pulling forces are conveyed to any of the conductive stripes 130.

Optionally, HDMI connector assemblies 100 and 101 include protecting means to protect the garment-processing device (not shown) that is electrically connected to such connector-and-cable assembly (100 or 101) from the current/voltage surge inflicted by a current/voltage providing device, such as a defibrillator, that is activated onto at least one electrode that is electrically connected to garment-processing device.

Figure 5:
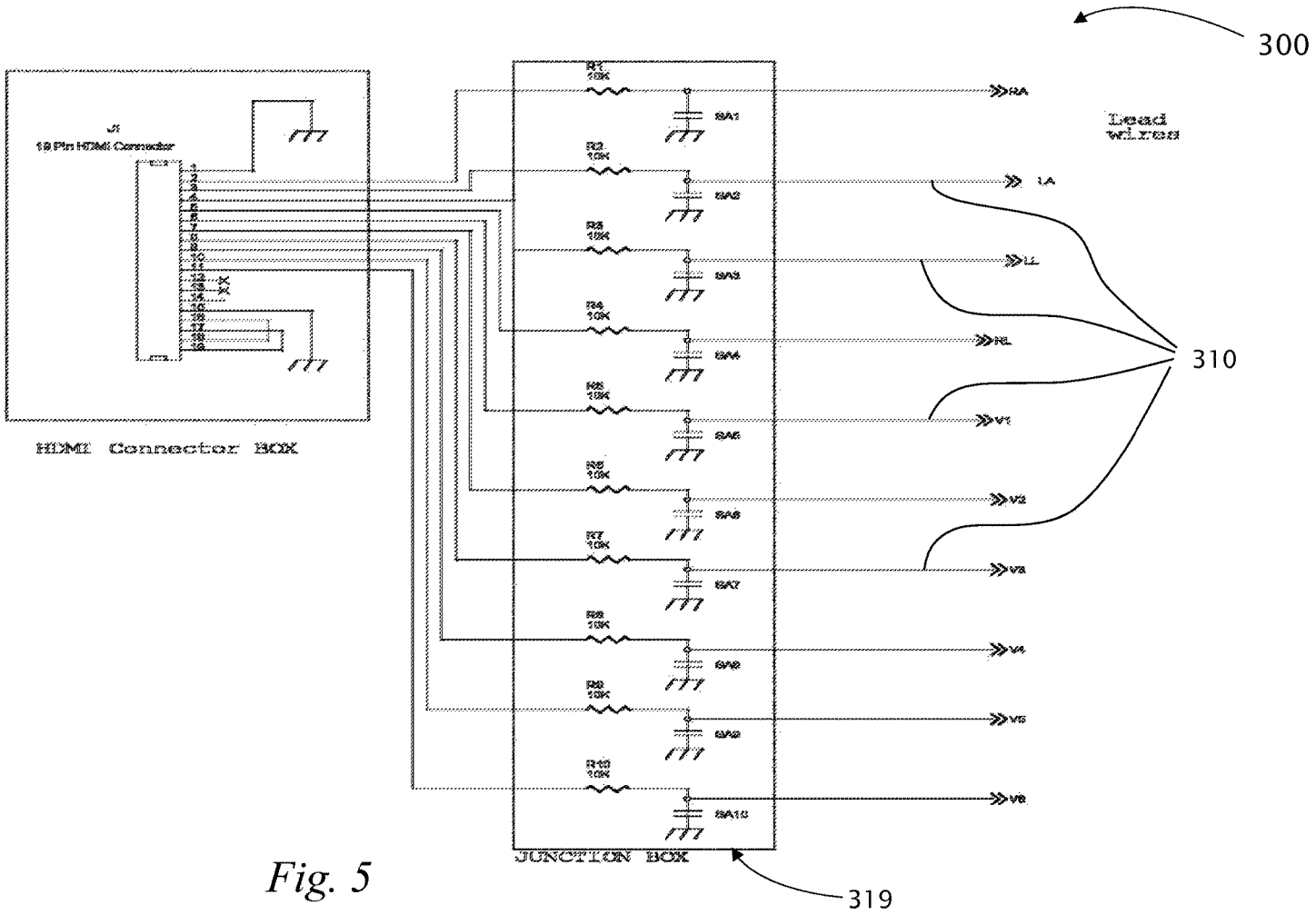
FIG. 5 is a schematic electrical illustration of the HDMI connector assemblies shown in FIGS. 3*a* and 4.

Reference is now made to FIG. 5, a schematic illustration an electrical scheme 300 of the HDMI connector assemblies 100 and 101. The HDMI circuitry includes individual electric lines 310 for each incoming conductive stripes 130. At least one electric line 310 includes a protective means 319 that breaks open at least one electric line 310 upon a high electric surge, to thereby prevent the high electric surge from reaching the garment-processing device. In some embodiments of the present invention the protecting means may include Zener diodes and/or other current surge protecting means such as, with no limitations, ZL70584 an eight-terminal IC, for example.

Figure 6:
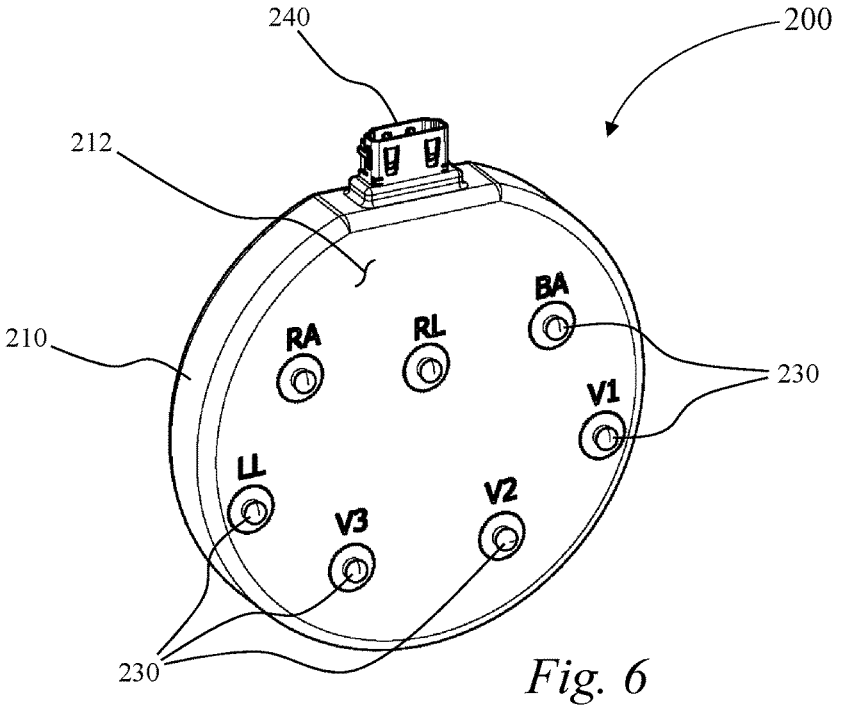
FIG. 6 is a perspective view of an example HDMI I/F device having a paired-connector inlet and showing a first face of the HDMI I/F device that provides a first set of snap buttons.
Figure 7:
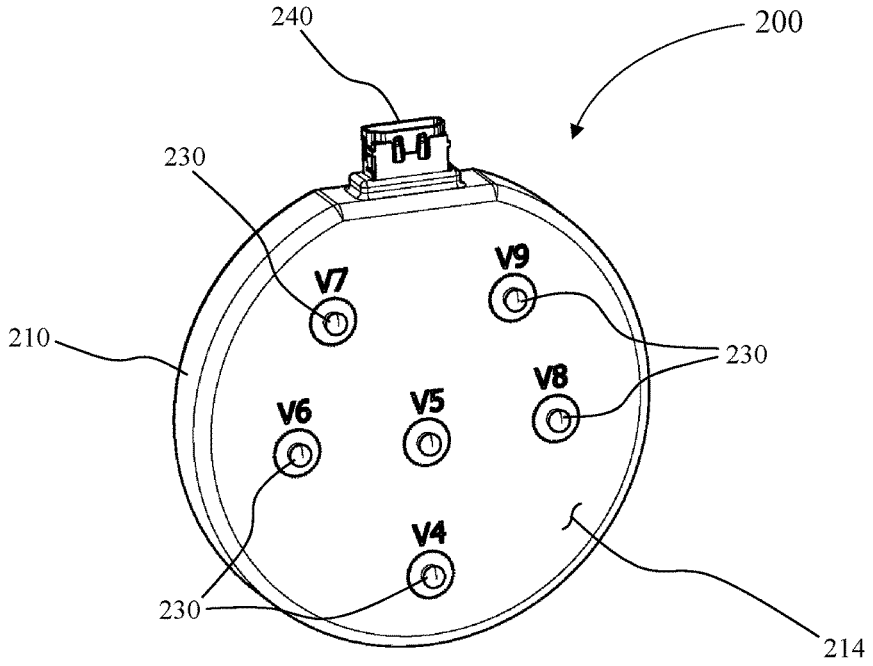
FIG. 7 is a perspective view of the example HDMI I/F device as in FIG. 6, but showing a second face of the HDMI I/F device that provides a second set of snap buttons.
Figure 8:
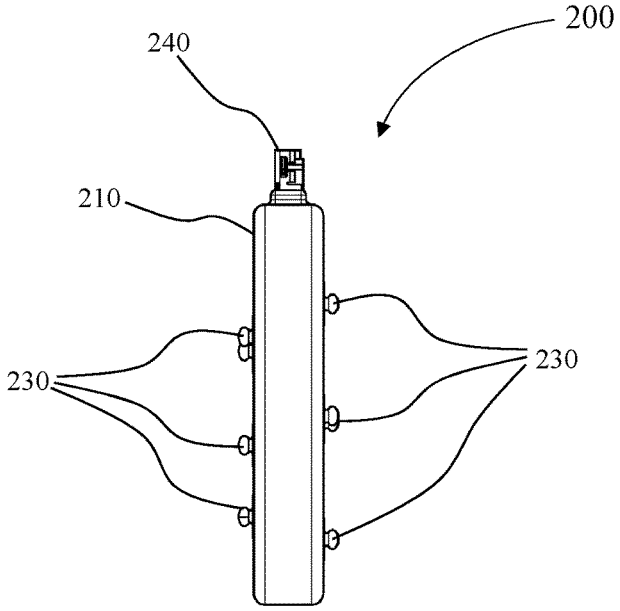
FIG. 8 is a side view of the example HDMI I/F device as in FIG. 6.

It is an aspect of the present invention to provide an HDMI interface (I/F) device facilitating any ECG processing and monitoring unit to operatively connect to the smart garment 50 via HDMI connector 110. FIGS. 6-8 illustrate an example HDMI I/F device 200, according to embodiments of the present invention, having a housing 210, a paired-connector inlet 240 adapted to operatively connect to connector 110, and a number of snap buttons 230 electrically connected to paired-connector inlet 240. FIG. 6 is a perspective view of paired-connector inlet 240 showing a first face 212 of HDMI I/F device 200, providing a first set of snap buttons 230; FIG. 7 is a perspective view of paired-connector inlet 240 showing a second face 212 HDMI I/F device 200 that provides a second set of snap buttons 230; and FIG. 8 is a side view of paired-connector inlet 240.

Figure 9:
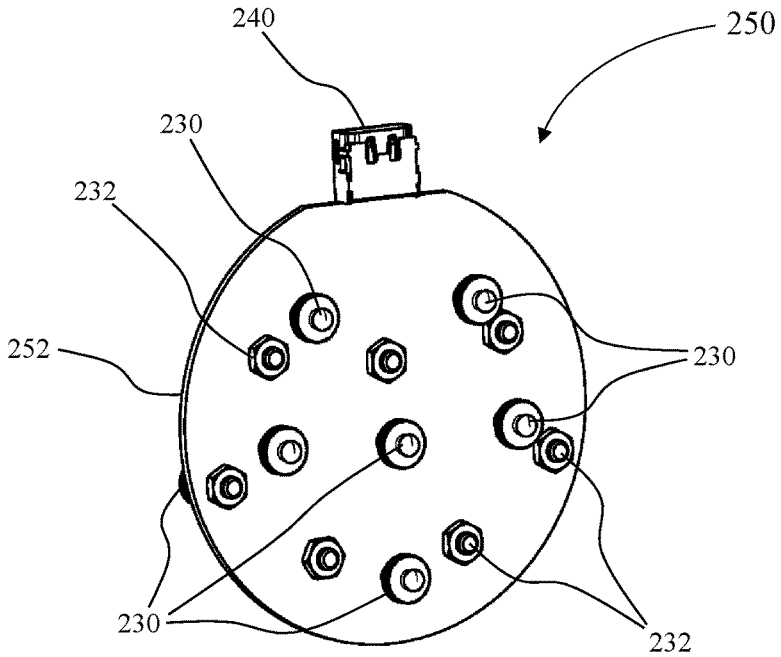
FIG. 9 is a perspective view of a PCB assembly of the example HDMI I/F device as in FIG. 6, wherein the housing covers have been removed, for illustrative purposes only.

FIG. 9 is a perspective view of an example printed circuit board (PCB) assembly 250 of HDMI I/F device 200, where housing covers 212 and 214 that have been removed from FIG. 8 for illustrative purposes only. PCB assembly 250 includes PCB board 252, paired-connector inlet 240, wherein snap buttons 230 are securely attached to PCB board 252 at preconfigured location, using devices such as, with no limitation, nuts 232. Snap buttons 230 are securely attached to PCB board 252 such that when paired-connector inlet 240 is operatively connected to connector 110, each snap button 230 is electrically connected to the respective pin 118 of connector 110.

Typically, common ECG processing units are adapted to connect using either snap buttons or crocodile connectors. However the present invention is not limited to connect using snap buttons or crocodile connectors, and can be adapted to use any other connector.

Optionally, protective means 319 that breaks open at least one electric line 310 (see FIG. 5) upon a high electric surge, is built into the circuitry of PCB board 252.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A connector assembly, comprising:

a. an electronic connector having an outlet section; and b. a multiplicity of elastic conductive textile stripes comprising conductive textile yarn, wherein each said elastic conductive textile stripes is conductively connected, at a first end, to a respective preconfigured outlet pin of said electronic connector; and wherein a second end of each said elastic conductive textile stripes is preconfigured to operatively attach to a respective sensor.

2. The connector assembly as in claim 1, wherein said electronic connector is a HDMI connector.

3. The connector assembly as in claim 1, wherein said sensor is a textile electrode of a smart garment.

4. The connector assembly as in claim 1 is made of materials withstanding washing by washing machines and drying by drying machines.

5. The connector assembly as in claim 1, wherein said electronic connector includes a PCB board having a multiplicity of connector pins, wherein each said elastic conductive textile stripes is securely and conductively attached to a respective pin of said multiplicity of connector pins.

6. The connector assembly as in claim 5, wherein said securely attachment of each said elastic conductive textile stripes to a respective pin of said multiplicity of connector pins is done either by pressing said respective pin onto said respective conductive textile stripe, or by using conductive glue or by a combination thereof.

7. The connector assembly as in claim 5, wherein said PCB board comprises at least one protective means that breaks open a respective electric line, upon a high electric surge.

8. The connector assembly as in claim 1, wherein said electronic connector includes a connector-housing, and wherein said connector-housing and a portion of said elastic conductive textile stripes, proximal to the electronic connector, are wrapped by a mold.

9. The connector assembly as in claim 1 further including a fitted cap plugged into the open end of said electronic connector, to thereby further seal the connector assembly.

10. The connector assembly as in claim 1 further including an attachment element for securing the connector assembly onto a smart garment.

11. The connector assembly as in claim 1, wherein said outlet section of said electronic connector is generally perpendicular to the incoming direction of said conductive textile stripes, entering said electronic connector.

12. A HDMI interface (I/F) device facilitating any external monitoring unit to operatively connect to the smart garment via the connector assembly of claim 1, HDMI interface (I/F) device comprising:

a. a paired-connector inlet;

b. an I/F housing having a first face and a second face; and c. a PCB I/F assembly, wherein each said paired-connector inlet is adapted to operatively connect to said outlet section of said electronic connector;

wherein a predetermined number of external connecting means are securely attached to said PCB I/F assembly at preconfigured location at one or both sides of said PCB I/F assembly; and wherein respective openings, at locations corresponding to locations of said external connecting means on said PCB I/F, are formed in said first and/or second faces of said I/F housing, to facilitate access to said external connecting means.

13. The connector assembly as in claim 12, wherein said paired-connector inlet is adapted to fit said outlet section of said electronic connector.

14. The connector assembly as in claim 12, wherein said external connecting means is selected from the group including snap buttons and crocodile connectors.

15. The connector assembly as in claim 12, wherein said PCB I/F assembly comprises at least one protective means that breaks open a respective electric line upon a high electric surge.

16. The connector assembly as in claim 12, wherein the external monitoring unit is an ECG processing and monitoring unit.

* * * * *